US009822421B2

(12) United States Patent
Pohl et al.

(10) Patent No.: US 9,822,421 B2
(45) Date of Patent: Nov. 21, 2017

(54) METHOD FOR PRODUCING PRESS-HARDENED COMPONENTS FOR MOTOR VEHICLES

(75) Inventors: Martin Pohl, Altenbeken (DE); Michael Wibbeke, Paderborn (DE); Wilfried Rostek, Paderborn (DE)

(73) Assignee: VICTOCOR TECHNOLOGIES N.V. (BE)

( * ) Notice: Subject to any disclaimer, the term of this patent is extended or adjusted under 35 U.S.C. 154(b) by 1273 days.

(21) Appl. No.: 12/798,082

(22) Filed: Mar. 29, 2010

(65) Prior Publication Data

US 2010/0319426 A1 Dec. 23, 2010

(51) Int. Cl.

| | |
|---|---|
| ***B21D 35/00*** | (2006.01) |
| ***C21D 1/673*** | (2006.01) |
| ***B21D 22/02*** | (2006.01) |
| ***B21D 53/88*** | (2006.01) |
| ***C21D 1/18*** | (2006.01) |
| ***C21D 1/74*** | (2006.01) |
| ***C21D 8/02*** | (2006.01) |
| ***C21D 8/04*** | (2006.01) |
| ***C21D 9/00*** | (2006.01) |
| ***C21D 9/46*** | (2006.01) |
| ***C21D 9/48*** | (2006.01) |
| ***C23C 10/28*** | (2006.01) |

(52) U.S. Cl.

CPC ..... *C21D 1/673* (2013.01); *B21D 22/022* (2013.01); *B21D 35/00* (2013.01); *B21D 53/88* (2013.01); *C21D 1/18* (2013.01); *C21D 1/74* (2013.01); *C21D 8/0205* (2013.01); *C21D 8/0257* (2013.01); *C21D 8/0405* (2013.01); *C21D 9/0068* (2013.01); *C21D 9/46* (2013.01); *C21D 9/48* (2013.01); *C23C 10/28* (2013.01)

(58) Field of Classification Search

USPC ..... 72/342.1–342.96, 46, 47; 29/897.2, 458; 118/59, 101, 202

See application file for complete search history.

(56) References Cited

U.S. PATENT DOCUMENTS

| | | | | |
|---|---|---|---|---|
| 4,130,933 | A * | 12/1978 | Demrick | 29/564 |
| 5,856,378 | A * | 1/1999 | Ring et al. | 523/205 |
| 7,137,201 | B2 | 11/2006 | Brodt et al. | |
| 7,254,977 | B2 * | 8/2007 | Machrowicz et al. | 72/342.3 |
| 2006/0219334 | A1 * | 10/2006 | Brodt et al. | 148/647 |
| 2006/0283530 | A1 * | 12/2006 | Knaup et al. | 148/641 |

FOREIGN PATENT DOCUMENTS

| | | | |
|---|---|---|---|
| DE | 2452486 | A1 | 5/1975 |
| DE | 10333165 | A1 | 2/2005 |
| GB | 1490535 | | 11/1977 |
| WO | 2005018848 | A1 | 3/2005 |
| WO | WO-2008024042 | A1 | 2/2008 |

OTHER PUBLICATIONS

European Search Report dated Apr. 4, 2012 for EP10002910.7.

* cited by examiner

*Primary Examiner* — Matthew G Katcoff

(74) *Attorney, Agent, or Firm* — Fishman Stewart PLLC

(57) ABSTRACT

A method for making a vehicle body component includes forming a generally flat plate of unhardened, hot-formable sheet steel with a marginal shape which corresponds essentially to the developed configuration of the finished vehicle body component. The formed plate is hot-formed and hardened in a single press tool to define a sheet profile which corresponds to the configuration of the finished vehicle body component, and a surface coating is applied to the sheet profile.

17 Claims, No Drawings

METHOD FOR PRODUCING PRESS-HARDENED COMPONENTS FOR MOTOR VEHICLES

CLAIM OF PRIORITY

Applicants hereby claim the priority benefits under the provisions of 35 U.S.C. §119, basing said claim of priority on German Patent Application 10 2009 017 326.9, filed Apr. 16, 2009. In accordance with the provisions of 35 U.S.C. §119 and Rule 55(b), a certified copy of the above-listed German patent application will be filed before grant of a patent.

BACKGROUND OF THE INVENTION

The present invention relates to a method for producing press-hardened components, in particular motor vehicle body components, from a plate of unhardened, hot-formable steel sheet. In the method, the plate is hot-formed and hardened in a press tool, thereby creating a sheet profile.

Prior art DE 24 52 486 A1 discloses a method for producing a hardened sheet profile from a plate in a press-hardening process. A plate comprising a hardenable steel is heated to hardening temperature, and then is hot-formed in a press tool, and subsequently hardened while the sheet profile remains in the press tool. A product with good dimensional stability is obtained, since the sheet profile is held in the press tool during the cooling that occurs during the hardening process.

Hot-forming and hardening in a press tool is an economical operating method, because both the forming and the hardening or aging processes are combined in a single tool.

Given this background, WO 2005/018848 A1 describes methods in which a component blank is formed initially using a cold-forming process, in particular a drawing process, and the margin of the component blank is then trimmed to correspond approximately to the marginal contour of the component to be produced, or, wherein after the forming and hardening processes, the margin of the press-hardened component blank is cut to correspond to the marginal contour of the component to be produced. The press-hardened component blank is coated with an anti-corrosion layer in a subsequent processing step.

In general, profile components made of sheet steel, especially motor vehicle components, are provided with a surface coating to protect against corrosion. Applying the surface coating to the component using a thermal diffusion method is known. This is explained in WO 2005/018848 A1, inter alia. A layer of zinc or a zinc alloy is preferably applied as a surface coating.

SUMMARY OF THE INVENTION

An object of the present invention is to render the procedure for producing press-hardened components even more economical.

According to the present invention, this object is attained in a method in accordance with the features of claim 1.

The subject matter of dependent claims 2 through 11 includes advantageous refinements and embodiments of the inventive method.

In accordance with the present invention, the initial part or workpiece for the motor vehicle component to be produced is a generally flat plate that is produced with a geometry that essentially corresponds to the sheet blank or developed shape of the finished component. The geometry of the cut or fabricated plate corresponds to the sheet blank or developed shape of the finished component, taking into account geometric changes to the component resulting from the forming process. Then, this fabricated plate is formed and press-hardened in a hot-forming tool, thereby creating the component. Then, the hot-formed component is provided with a surface coating. After the hot-forming process, the formed and press-hardened component has its final geometry. In this manner, it is possible to produce motor vehicle components in an economical manner, since it is not necessary to trim the margins on the produced component or even the component blanks.

During press-hardening, the component is cooled while being held in the hot-forming tool to harden it. This active cooling process lowers the temperature of the component, specifically to a temperature that is less than or equal to 300° C., preferably to a temperature between 180° C. and 300° C., especially to approximately 200° C. Distortion of the formed and press-hardened component is prevented in this temperature range.

The surface coating for the press-hardened component is preferably applied using a diffusion process with the heat treated component. The hot-formed component is brought into contact with a metal powder. The profile component is subjected to heat treatment at a temperature of between 350° C. and 410° C. for a period of 0.25 to 3.0 hours. A diffusion process between the steel sheet and the metal powder forms solid iron-zinc alloy layers that are bonded together, and have a thickness of between 5 μm and 40 μm.

In this manner, it is possible to provide three-dimensional formed components, especially auto body components such as "B" columns, door intrusion beams, and side skirts, with a high quality, long-lasting coating. The coating provides good protection against corrosion, and can also be welded. The profile components can be coated without suffering any disadvantageous losses in strength due to the heat treatment.

In one example of the present invention, a metal powder having primarily zinc or zinc oxide as its main component is used, and may contain additives for enhancing the chemical and physical properties of the coating. The surface coating produced is uniform and relatively ductile.

Prior to coating, the press-hardened profile components are subjected to a surface treatment. The profile components are cleaned so that they are metal blanks. This can be accomplished using a pickling process for instance. A dry cleaning method, especially sandblasting, is preferred.

The thickness of the coating is a function of the temperature and length of treatment. As previously stated, for the present invention, the heat treatment is at a temperature of between 350° C. and 410° C., more specifically, a temperature range from 370° C. to 400° C., and preferably at approximately 380° C.

The invention also provides for using the residual heat of the component from the hot-forming process. The coating process is initiated with the starting temperature or intermediate temperature. The formed and press-hardened component is transferred to the coating process at the temperature it has after leaving the hot-forming tool. In accordance with the present invention, this temperature is between 180° C. and 300° C., and particularly approximately 200° C. This leads to a further increase in the efficiency of the method, and shortens the period for the heat treatment during the surface coating process.

The heat treatment process is divided into a heating phase, wherein the treatment temperature is attained, and a holding phase, wherein the treatment temperature is maintained for a certain period of time. The heating phase preferably lasts for a period that is less than or equal to 0.25 hours. In certain cases, it is possible for the heat treatment process to conclude after the heating phase. Therefore, a holding phase that lasts for a period of 0.0 to 2.0 hours can be assumed. The holding temperature in the given temperature range is greater than 350° C.

Once the coating process or heat treatment has concluded, the coated profile components are cooled uniformly. The cooling process should take less than 1.0 hour for the sake of economy.

Cooling may fundamentally occur in air. Preferably, active cooling is used, with a cooling medium acting on the coated profile components. In the present invention, it is particularly useful for the cooling medium to provide active cooling by acting on the coated profile components, wherein the coated components are cooled after the heat treatment to a temperature of <300° C., preferably to a temperature of between 180° C. and 300° C., and especially approximately 200° C. The goal of this active cooling step is to prevent an oxide layer from forming on the surface of the coated components. Protective or inert gas is preferably used for the cooling medium. Cooling occurs especially in an inert gas atmosphere, that is, in the space in which the components are brought into contact with the metal powder, and in which the surface coating is produced.

In accordance with the present invention, all of the margin contour trimming on the initial plate occurs prior to the press-hardening. No margin contour trimming is performed after the forming and/or press-hardening. However, it is possible for the plate to be perforated prior to or even after the forming.

Moreover, with the present invention it is also possible to perform the method and the press-hardening such that areas with different strengths result on the formed and press-hardened component. This can be accomplished using suitable temperature control for the press-hardening, such as in a hot-forming tool in which zones are provided that have different cooling gradients.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A method for making a press-hardened vehicle body component from a plate of unhardened, hot-formable sheet steel, comprising:

forming a generally flat plate of unhardened, hot-formable sheet steel with a marginal shape which corresponds essentially to the developed configuration of the finished vehicle body component;

after said plate forming step, hot-forming and hardening the formed plate in a single press tool to define a sheet profile which corresponds to the configuration of the finished vehicle body component; wherein said hardening step includes cooling the sheet profile to a temperature in the range of 180° C. to 300° C.;

after said hot-forming and hardening steps, surface coating the sheet profile; and using a residual heat of the hot forming process in the formed plate to initiate the surface coating process, including initiating the surface coating process by contacting a metal powder with the sheet profile, the residual heat of the hot forming process thereby bonding the metal powder to the sheet profile to form a coating layer on the sheet profile.

2. A method as set forth in claim 1, wherein:

said surface coating step comprises diffusion coating.

3. A method as set forth in claim 2, including:

cooling the coated sheet profile after said surface coating step.

4. A method as set forth in claim 3, wherein:

said sheet profile cooling step includes cooling the sheet profile in an inert gas atmosphere.

5. A method as set forth in claim 1, including:

after said hardening step, cooling the sheet profile to a temperature of approximately 200° C.

6. A method as set forth in claim 1, including:

perforating the plate prior to said plate forming step.

7. A method as set forth in claim 1, including:

perforating the plate after said plate forming step.

8. A method as set forth in claim 1, wherein:

said hardening step includes forming areas having different strengths on the sheet profile.

9. A method as set forth in claim 1, further comprising establishing a margin contour of the plate prior to the hot-forming operation such that the margin contour is defined when the plate is in a relatively unhardened state.

10. A method as set forth in claim 1, wherein the formed plate is at a hot forming temperature above approximately 300 degrees Celsius when the plate is hot formed, wherein the formed plate is cooled to a coating temperature below approximately 300 degrees Celsius and above approximately 180 degrees Celsius after the plate is hot formed, and the formed plate is transferred to the coating process at the coating temperature.

11. A method as set forth in claim 10, wherein the coating temperature is approximately 200 degrees Celsius.

12. A method as set forth in claim 1, wherein an associated hot-forming tool used to hot form the formed plate includes a plurality of zones having different cooling gradients, the plurality of zones configured to form corresponding areas of different strengths in the formed plate.

13. A method as set forth in claim 8, wherein the different strengths are formed in different areas of the sheet profile with corresponding different cooling gradients in an associated hot-forming tool used to hot form the formed plate.

14. A method as set forth in claim 1, further comprising transferring the formed plate directly from the hot-forming process to the coating process.

15. A method as set forth in claim 1, wherein said surface coating step comprises contact with the metal powder at a first temperature.

16. A method as set forth in claim 15, wherein said first temperature is no less than 180 degrees Celsius.

17. A method as set forth in claim 1, further comprising initiating the surface coating process with the residual heat of the hot forming process when the formed plate has a first temperature of no less than 180 degrees Celsius; and subjecting the formed plate to a second temperature of no less than 350 degrees Celsius, thereby forming a solid coating layer from the metal powder.

* * * * *